US008616301B2

(12) United States Patent
John et al.

(10) Patent No.: US 8,616,301 B2
(45) Date of Patent: Dec. 31, 2013

(54) PNEUMATIC HAMMER MECHANISM

(75) Inventors: Alexander John, St. Johann-Ob Hohenburg (AT); Reinhard Schulz, Munich (DE); Eduard Pfeiffer, Halblech (DE)

(73) Assignee: Hilti Aktiengesellschaft, Schaan (LI)

( * ) Notice: Subject to any disclaimer, the term of this patent is extended or adjusted under 35 U.S.C. 154(b) by 124 days.

(21) Appl. No.: 12/697,051

(22) Filed: Jan. 29, 2010

(65) Prior Publication Data

US 2010/0224383 A1 Sep. 9, 2010

(30) Foreign Application Priority Data

Jan. 30, 2009 (DE) ..... 10 2009 008 190

(51) Int. Cl.
*E21B 4/14* (2006.01)

(52) U.S. Cl.
USPC ..... 173/49; 173/102

(58) Field of Classification Search
USPC ..... 173/49, 48, 47, 201, 210, 211, 101, 173/102, 200, 204; 92/60.05, 129, 169.1
See application file for complete search history.

(56) References Cited

U.S. PATENT DOCUMENTS 3,559,751 A 2/1971 Yamada
4,014,392 A * 3/1977 Ross ..... 173/118
4,114,699 A * 9/1978 Wolf ..... 173/109
4,201,269 A * 5/1980 Ross ..... 173/1
4,991,664 A * 2/1991 Kolgan et al. ..... 173/201
2002/0056558 A1* 5/2002 Bongers-Ambrosius et al. ..... 173/201

FOREIGN PATENT DOCUMENTS

DE 39 10 598 A1 10/1990
EP 1 607 186 A1 12/2005
EP 1 779 980 A2 5/2007
SU 1 579 766 A1 7/1990

OTHER PUBLICATIONS

German Search Report, dated Jul. 27, 2009, 3 pages.

* cited by examiner

*Primary Examiner* — Alexandra Elve
*Assistant Examiner* — Nathaniel Chukwurah
(74) *Attorney, Agent, or Firm* — Crowell & Moring LLP

(57) ABSTRACT

A pneumatic hammer mechanism is disclosed. The hammer mechanism features: a flying mass, which is movable along an impact axis; an impact surface, which limits a movement of the flying mass along the impact axis in the impact direction; an exciting piston, which limits a movement of the flying mass along the impact axis opposite from the impact direction; a pneumatic chamber between the flying mass and exciting piston; and a drive for periodically moving the exciting piston with a stroke along the impact axis. The flying mass is excited to a periodic movement between the impact surface and a minimum approach of the exciting piston. A length ratio of the maximum length of the pneumatic chamber to the stroke is selected as less than 1.55.

7 Claims, 6 Drawing Sheets

PNEUMATIC HAMMER MECHANISM

This application claims the priority of German Patent Document No. 10 2009 008 190.9, filed Jan. 30, 2009, the disclosure of which is expressly incorporated by reference herein.

BACKGROUND AND SUMMARY OF THE INVENTION

The present invention relates to a pneumatic hammer mechanism, in particular an electrically driven, pneumatic hammer mechanism, for a power tool, in particular a hand power tool, e.g., a chipping hammer.

An electrically operated chipping hammer having a pneumatic hammer mechanism is known from European Patent Document No. EP 1 779 980 A2 among others. A schematic representation of its hammer mechanism 501 from FIG. 6 is incorporated as FIG. 1.

A flying mass 569 is arranged in a piston cylinder 530 between a hammer piston 520 and an end piece of a tool 599. The flying mass 569 and the hammer piston 520 make an airtight seal with a wall of the piston cylinder so that a sealed airtight chamber 580 is formed between the flying mass 569 and the hammer piston 520. The chamber 580 will be called pneumatic chamber 580 in the following.

The hammer piston 520 moves periodically in a reciprocating manner in the piston cylinder 530, driven by a gear wheel 522, 523, 531. The flying mass 569 is also excited to move periodically between the hammer piston 520 and the end piece of the tool 599 based on its coupling to the hammer piston 520 by means of the pneumatic chamber 580.

FIG. 2 schematically shows the progression of movement of the hammer piston 520 and flying mass 569 over time t; the progression among other things is also depicted in FIG. 13A of EP 1 779 980 A2. The local axis x indicates the distance from the end piece of the tool 599. When the hammer piston 520 moves at its greatest velocity in the direction of the tool 599 (at small x values), the hammer piston 520 and the flying mass 569 come as close as possible. The pneumatic chamber 580 is heavily compressed in the process and as a result accelerates the flying mass 569 in the direction of the tool 599. After this, the flying mass 569 strikes undamped the end piece of the tool 599. A portion of the kinetic energy of the flying mass 569 is transferred in the process to the tool. As with a partial elastic impact with a heavy impact mate, the flying mass 569 reverses its direction of movement and moves with reduced velocity in the direction of the hammer piston 520. The stroke H of the hammer piston 520, the angular velocity of the hammer piston 520 and the maximum length of the pneumatic chamber 580 are coordinated with each other such that the movement of the flying mass 569, as depicted, is excited resonantly by the hammer piston 520.

There is the need to further increase the impact effect of the chipping hammer without increasing the power consumption of the chipping hammer in the process. The impact effect of the chipping hammer is produced essentially from the energy released by an impact in a work piece. The power consumption is yielded from the product of the energy released per impact and the impact frequency of the impacts. Consequently, the impact frequency of the impacts must be reduced.

The energy released by each impact depends upon the kinetic energy that the flying mass 569 collects up until impact. The acceleration work is performed by the hammer piston 520, which increases with increasing velocity of the hammer piston 520 in the piston cylinder 530. The velocity of the hammer piston 520 is predetermined by the angular velocity and the stroke H of the hammer piston 520. Even though increasing the angular velocity based on the impact frequency of the impacts that increases with it is not suitable, the stroke H of the hammer piston 520 can be increased. However, this requires a greater maximum length of the pneumatic chamber 580 and thus a longer hammer mechanism in order to guarantee a resonant excitation of the flying mass 569.

So that a user may hold the chipping hammer ergonomically during operation, the dimensions of the chipping hammer and thus also of the hammer mechanism are restricted, however.

The kinetic energy of the flying mass 569 can also be achieved by increasing its mass, however, an operator then experiences a greater recoil during acceleration of the flying mass 569 from the hammer piston 520.

One objective is making a percussive power tool available that facilitates an improved impact effect taking ergonomic aspects into consideration.

The hammer mechanism features: a flying mass, which is movable along an impact axis; an impact surface, which limits a movement of the flying mass along the impact axis in the impact direction; an exciting piston, which limits a movement of the flying mass along the impact axis opposite from the impact direction; a pneumatic chamber between the flying mass and exciting piston; a drive for periodically moving the exciting piston with a stroke H along the impact axis, wherein the flying mass is excited to a periodic movement between the impact surface and a minimum approach of the exciting piston. A length ratio of the maximum length L to the stroke H is selected as less than 1.55.

The maximum length of the pneumatic chamber is the distance of the exciting piston from the flying mass, when the exciting piston is arranged in its position away from the tool receptacle and the flying mass is arranged adjacent to the impact surface. The maximum length is used as the value to design and characterize the hammer mechanism. During operation, the pneumatic chamber as a rule does not occupy the maximum length at any point in time.

One cycle of the flying mass in the hammer mechanism is made up of a first phase with a movement from the minimum approach of the exciting piston to the impact and a second phase with a movement from the impact position to the next minimum approach of the exciting piston. The first phase and the second phase are completed together within a period of time, which is predetermined by the cycle duration of the movement of the exciting piston. Due to the deceleration of the flying mass until the momentary standstill, the duration of the second phase increases to the detriment of the duration of the first phase. The flying mass overcomes the distance between the minimum approach and the impact in a shorter time, ergo, as desired, with a higher velocity.

The deceleration of the flying mass during the second phase takes place if the dimensions of stroke and maximum length of the pneumatic chamber are suitably selected. The pneumatic chamber is compressed at the beginning of the second phase, because after the impact the exciting piston is still moving in the impact direction or the flying mass is initially moving with a greater velocity against the impact direction than the exciting piston. In this connection, an increase in pressure is produced in the pneumatic chamber, which decelerates the flying mass. The increase in pressure is all the greater, the smaller the volume of the pneumatic chamber or the greater the still remaining stroke movement of the exciting piston is in the direction of the impact surface.

Based on hammer mechanisms that have been realized and numeric simulations, it was recognized that with typical parameters with respect to the mass of the flying mass, a diameter of the pneumatic chamber and an impact frequency, in operation the cited ratio of 1.55 achieves an increase in the impact energy based on a slow movement of the flying mass in the second phase.

One embodiment of the present invention provides that the stroke is selected as a function of the maximum length of the pneumatic chamber such that the flying mass changes the direction of movement at least once during the movement between the impact surface and a following minimum approach of the exciting piston. A ratio of less than 1.50 can be advantageous for this. A change in the direction of movement during the second phase produces a longer path, which the flying mass covers during a cycle. The velocity of the flying mass is higher during the first phase, even taking the basic condition of the predetermined period of time for a cycle into consideration.

One embodiment provides that the stroke is selected as a function of the maximum length of the pneumatic chamber such that the flying mass touches the impact surface at least twice between two successive minimum approaches of the exciting piston. A ratio of less than 1.40 can be advantageous for this. The reversal of the direction of movement through the second impact produces a high velocity of the flying mass at the end of the second phase. The flying mass is thus able to closely approach the exciting piston and afterward experiences a greater acceleration in the direction of the impact surface due to the pneumatic chamber.

One embodiment provides that if the mass of the flying mass is greater than 400 g, the length ratio is selected as less than 1.55 and if the mass of the flying mass is less than 400 g, the length ratio is selected as less than 1.40.

One embodiment provides that if a ratio of the mass of the snap die to the mass of the flying mass is less than 1.2, the length ratio is selected as less than 1.40.

The following description explains the invention on the basis of exemplary embodiments and figures.

DETAILED DESCRIPTION OF THE DRAWINGS

Unless otherwise indicated, the same or functionally equivalent elements are identified by the same reference numbers in the figures.

Figure 1:
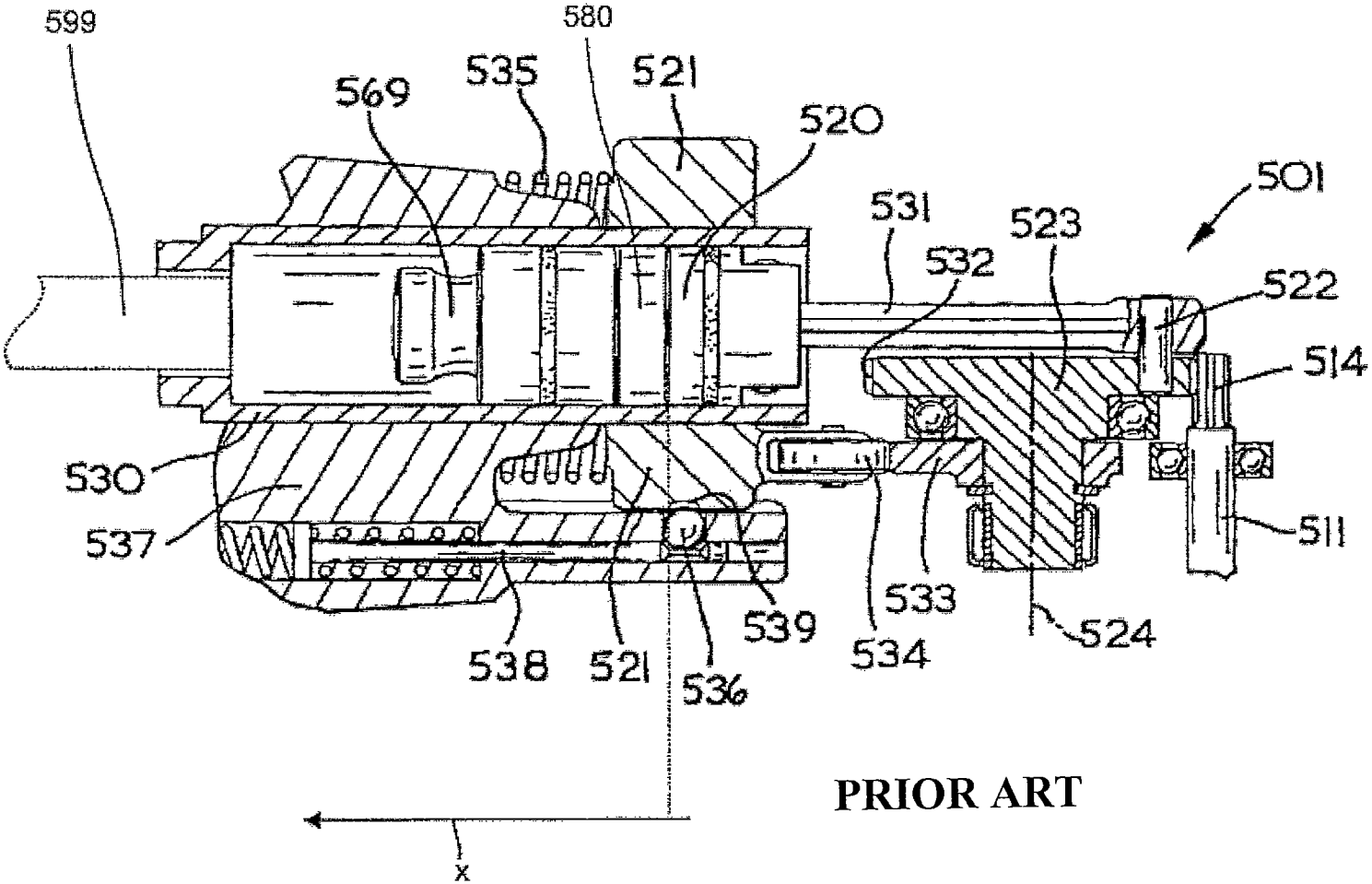
PRIOR ART Fig. 1
FIG. 1 is a section through a known hammer mechanism.
Figure 2:
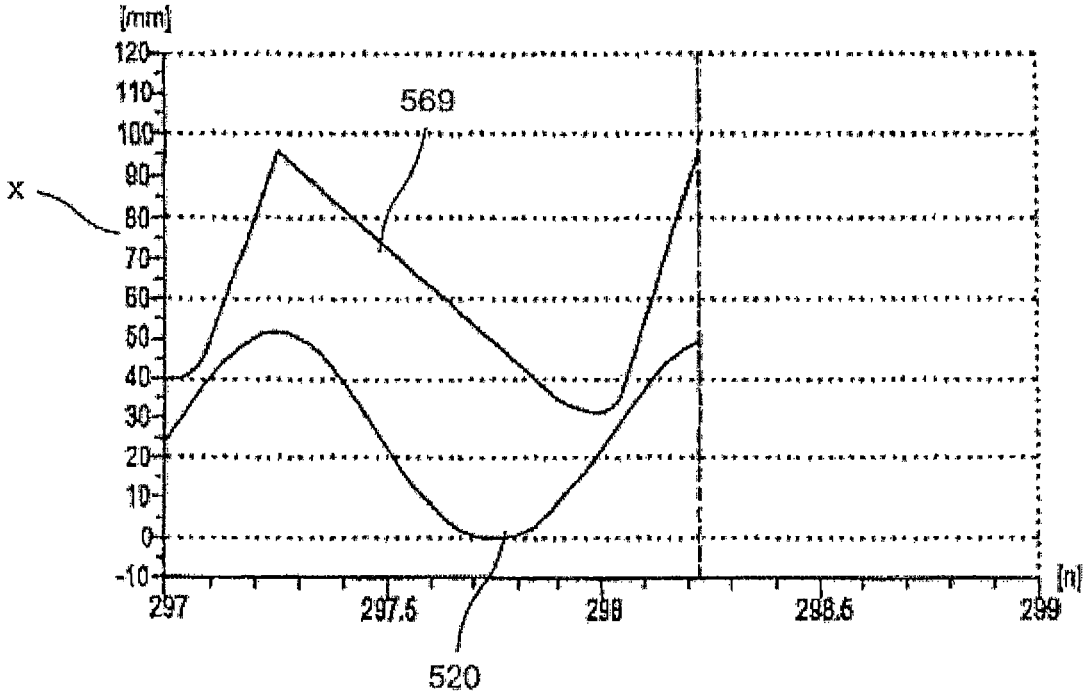
Fig. 2 PRIOR ART
FIG. 2 is a trajectory of a flying mass in the known hammer mechanism.
Figure 3:
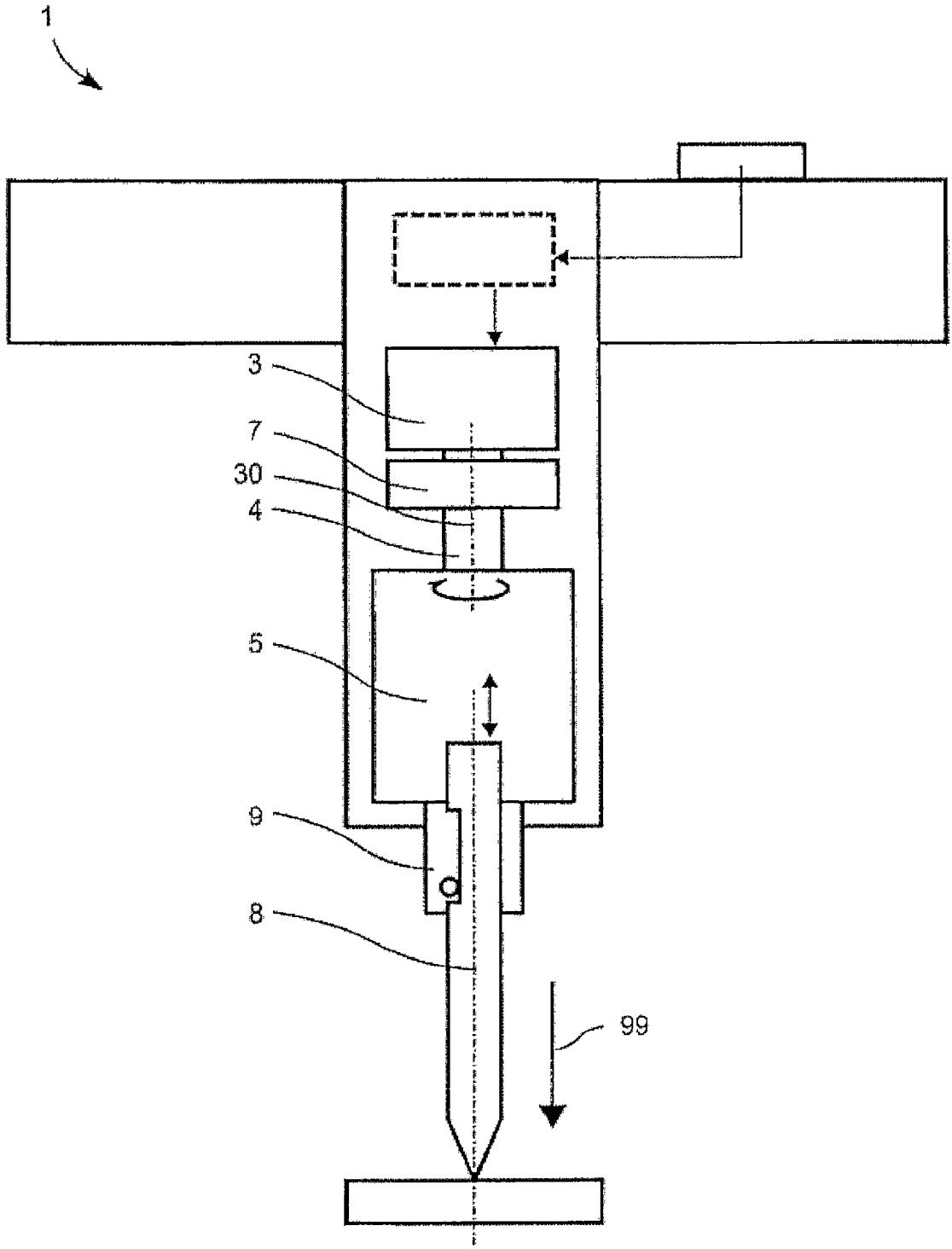
FIG. 3 is a section of an embodiment of a percussive hand power tool.

FIG. 3 schematically depicts an electro-pneumatic chipping hammer 1 as an example of a percussive hand power tool, other examples (not shown) are hammer drills and combination hammers, among others.

A drive train having a primary drive 3, a drive shaft 4 and a hammer mechanism 5 is arranged in a machine housing. A gear 7 can be connected between the primary drive 3 and the drive shaft 4. The primary drive 3 is preferably an electric motor, e.g., a universal motor or a brushless motor. The drive shaft 4 is rotated at rotational speeds in a range between 1 Hz and 100 Hz, e.g., at 10 Hz to 60 Hz. The rotational movement of the drive shaft 4 is transmitted by the hammer mechanism 5 in a periodic impact movement along an impact axis 8. A tool held in a tool holder 9 is driven from the chipping hammer 1 by periodic impacts along the impact axis 8 in impact direction 99. Returning the tool to the chipping hammer 1 against the impact direction 99 is accomplished by pressing the chipping hammer 1 on a work piece.

Figure 4:
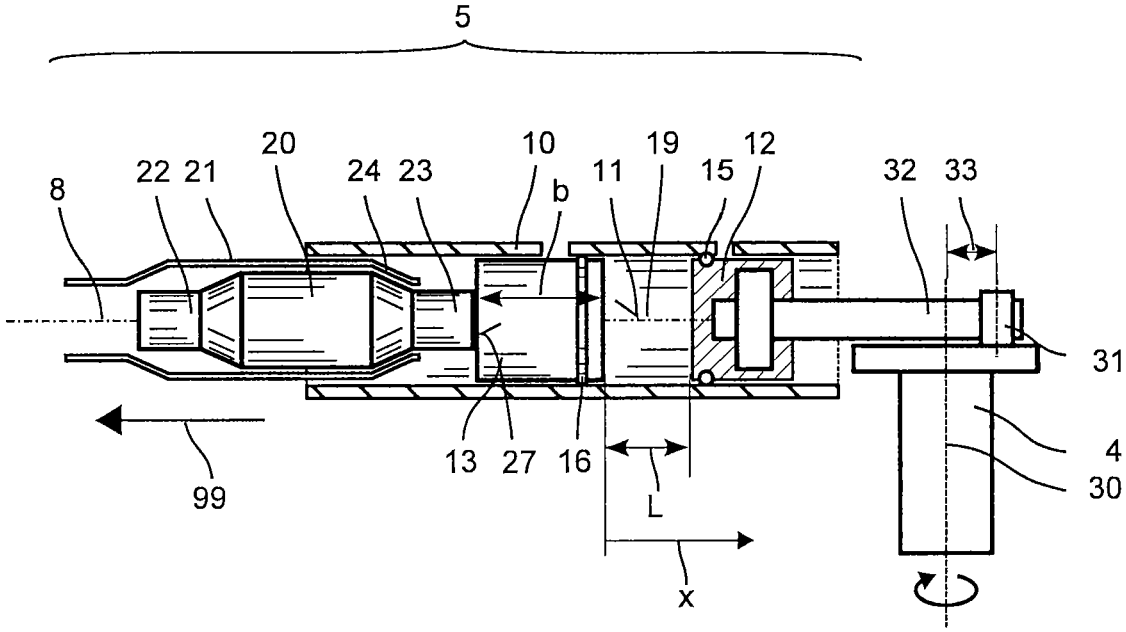
FIG. 4 is a section of an embodiment of a hammer mechanism.

FIG. 4 shows an exemplary structure of the hammer mechanism 5. The hammer mechanism 5 has an exciting piston 12 and a flying mass 13, which are moveable along the impact axis 8. In the depicted embodiment, the exciting piston 12 and the flying mass are guided through a wall 11 of a piston cylinder 10.

Positioned on a tool-side end of the piston cylinder 10 is a snap die 20 in a snap die guide 21. A tool-facing end 22 is in contact with a tool, which is held in the tool holder 9. An end 23 of the snap die 20 facing away from the tool projects out of the snap die guide 21 into the interior space of the piston cylinder 10. In percussive operation, the snap die 20 rests against an end 24 of the snap die guide 21 facing away from the tool. In this position, the end 23 of the snap die 20 facing away from the tool defines the position of the impact surface 27 of the hammer mechanism 5.

The snap die 20 can be provided, as embodied, as an intermediary between the flying mass 13 and a tool in the hammer mechanism 5. In particular, this makes a design of the hammer mechanism 5 possible which is independent of a mass of the tool being used. The snap die 20 for this can be selected to be considerably heavier than the typical mass of the tool.

In another embodiment, a snap die 20 is not provided. The flying mass 13 impacts directly on an end surface of the tool. In this case, the end surface forms the impact surface 27. The tool is inserted into the tool receptacle 9 as far as possible in the direction of the hammer mechanism 5. In this position, the tool defines the impact surface.

The exciting piston 12 is forced by the drive shaft 4 to make a periodic movement along the impact axis 8. The drive shaft 4 is rotated around its rotational axis 30 and in the process moves a wobble finger 31 arranged eccentrically to the rotational axis 30. The wobble finger 31 is connected to the exciting piston 12 via a rod assembly 32. A stroke H of the exciting piston 12 is defined as the distance between the two positions at which the exciting piston 12 is closest and furthest away from the impact surface 27. The stroke H of the exciting piston 12 is predetermined by the distance 33 of the wobble finger 31 from the rotational axis 30 and corresponds approximately to double the crank radius 33 of the wobble finger 31. The movement of the exciting piston 12 is periodic and, depending upon the design of the eccentric drive 4, the movement is sinusoidal or a good approximation of sinusoidal.

The exciting piston 12 and the flying mass 13 delimit a sealed airtight chamber lying between them, the pneumatic chamber 19. A cross-sectional area A of the pneumatic chamber 19 corresponds approximately to a cross-sectional area of the flying mass 13 and of the exciting piston 12. An airtight closure can be achieved, e.g., by sealing rings 15, 16. The pneumatic chamber 19 has a maximum length L when the exciting piston 12 is at a maximum distance from the impact surface 27 and the flying mass 13 is adjacent to the impact surface 27.

A simple model of the trajectory of the flying mass 13 is explained in the following on the basis of a conventional hammer mechanism and a hammer mechanism 5 according to one embodiment. The model is used to discover parameters of the hammer mechanism 5, with which the flying mass 13 is at least decelerated to a standstill between an impact on the impact surface 27 and a following minimum distance from the exciting piston 12 or even changes its direction of movement.

Figure 5:
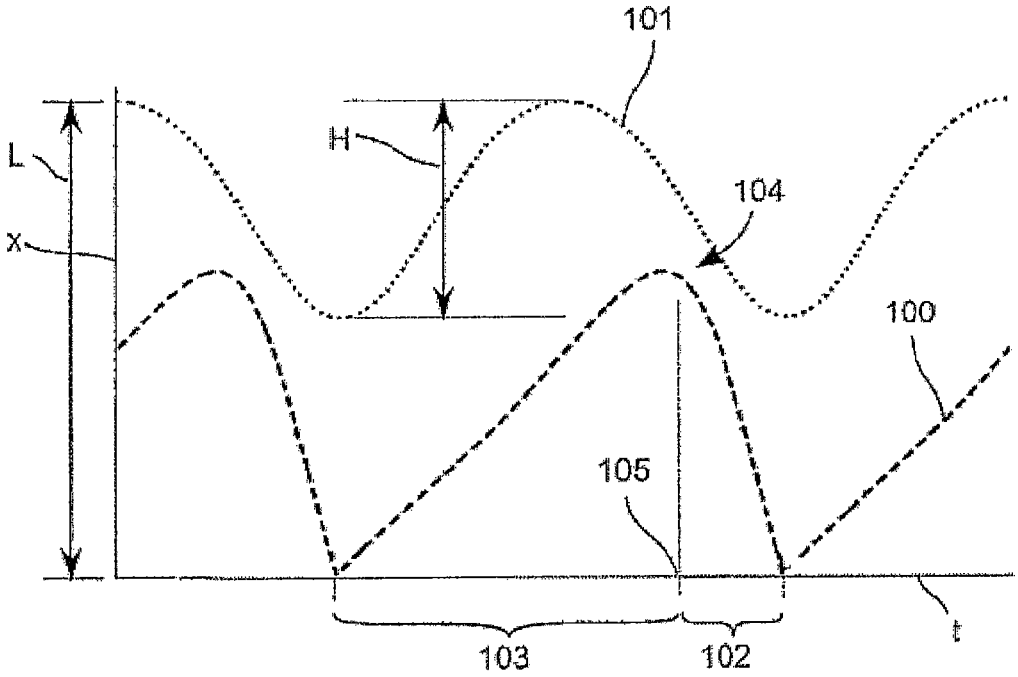
Fig. 5 PRIOR ART
FIG. 5 is a trajectory of a flying mass with known parameters of the hammer mechanism.
Figure 6:
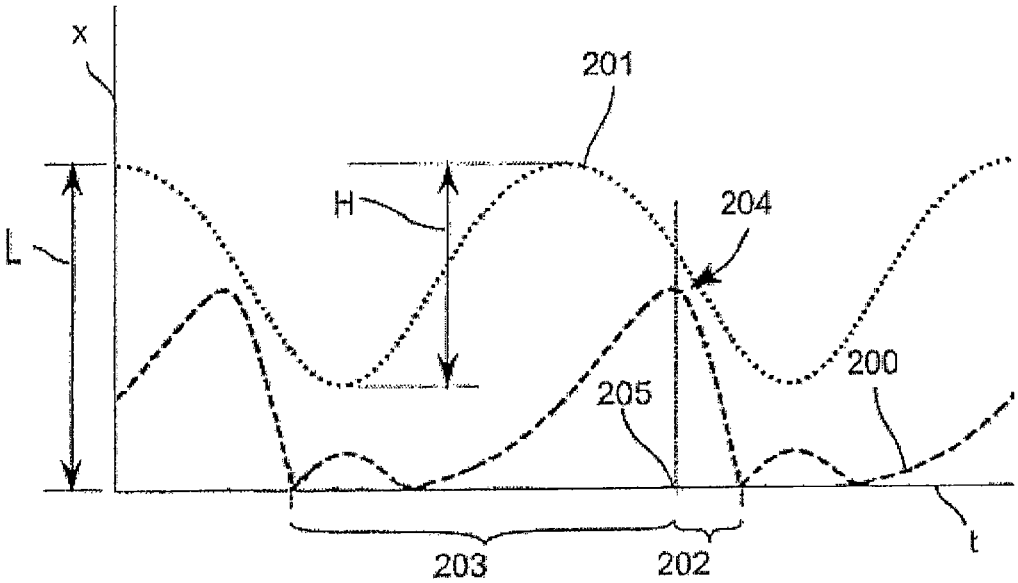
FIG. 6 is a trajectory of the flying mass of an embodiment of the hammer mechanism.

FIG. 5 shows a trajectory 100 of the flying mass 13 for a conventional, long hammer mechanism, plotted over the time t. The trajectory 100 is determined by means of an ad-initio simulation. The parameters of the hammer mechanism are: impact frequency f=14.5 Hz; mass of the snap die $m_1$=2.119 kg; mass of the flying mass $m_2$=1.248 kg; stroke H=0.094 m; maximum length of the pneumatic chamber L=0.204 m; cross-sectional area of the pneumatic chamber A=0.0034 $m^2$; impact coefficient q=0.25. The path curve 101 of the exciting piston 12 is also plotted. FIG. 6 shows a trajectory 200 of the flying mass 13 for a short hammer mechanism 5 according to one embodiment. The only parameter that has been changed as compared with FIG. 5 is the maximum length L of the pneumatic chamber: L=0.139 m.

The trajectory 100 of the long hammer mechanism can be divided into two phases 102, 103 delimited by reversal points 104, 105 of the trajectory 100. The first reversal point 104 is yielded by the minimum distance of the flying mass 13 from the exciting piston 12. The second reversal point 105 is produced by the impact of the flying mass 13 on the impact surface 27.

The trajectory in the area of the first reversal point 104 can be described by an impact of the flying mass 13 on the moved exciting piston 12. The effective mass of the exciting piston 12 is assumed to be infinite, because the exciting piston 12 is rigidly connected to the drive. Typical for a resonant excitation, the first reversal point 104 coincides with the maximum velocity of the exciting piston 12. The velocity $v_1$ of the flying mass 13 after the first reversal point 104 is therefore approximately $v_1=2\pi\cdot H\cdot f+v_3$, whereby $v_2$ designates the velocity prior to the first reversal point 104.

In the case of the impact of the flying mass 13 with the snap die 20 or the tool, the amount of the velocity $v_2$ of the flying mass 13 after the impact is less than the velocity $v_1$ prior to the impact, because a portion of the kinetic energy of the flying mass 13 is transferred to the snap die 20. The ratio (impact coefficient q) of the velocities $v_2/v_1$ is specified by the mass $m_2$ of the flying mass 13, the mass $m_1$ of the snap die 20 and a form factor e of the impact mates:

$$k = e \cdot \frac{m_2 - m_1}{m_2 + m_1}.$$

The form factor e has values of 0 to 1; for short compact impact mates in the vicinity of 1 and for more oblong structured impact mates in the vicinity of 0. Sample values for the impact coefficient k are in the range of 0.05 to 0.35. For example, the impact coefficient (q) can be selected as 0.22, if a ratio $m_1/m_2$ of the mass ($m_1$) of the snap die to the mass ($m_2$) of the flying mass (13) is greater than 1.2 and otherwise the impact coefficient (q) is selected as 0.12.

The volume V of the pneumatic chamber 19 changes during the first phase 102 and the second phase 103. Consequently, the pressure p within the pneumatic chamber 19 also changes. A force on the flying mass 13 is produced because of the pressure difference between the environment (approx. 1 bar) and the pressure p within the pneumatic chamber 19. The flying mass 13 thus experiences an acceleration between the two reversal points 104, 105, which increases or reduces its velocity $v_1$, $v_2$.

The pressure p can be estimated by an adiabatic approximation, in which $(p\cdot V)^\kappa$ is constant, whereby κ (kappa) designates the isentropic exponents (approximately 1.4 for air in the prevailing pressure range of 0.5 bar to 10 bar) and V the volume of the pneumatic chamber 19.

It is assumed that a neutral volume $V_0$ at which a pressure p in the pneumatic chamber 19 corresponds approximately to the normal pressure $p_0$ of the environment (approximately 1 bar), corresponds to half of the maximum length of the pneumatic chamber 19, i.e., if the distance x of the flying mass 13 to the exciting piston 12 is x=L/2.

In the case of the long hammer mechanism, the volume of the pneumatic chamber 19 in the first and second phases 102, 103 changes only negligibly compared to the neutral volume $V_0$. This is caused to some extent by the low stroke H, as compared to the maximum length L. Correspondingly, only minimum deviations from the ambient pressure $p_0$ and low forces on the flying mass 13 are yielded. The effect of the pneumatic chamber 19 on the movement of the flying mass 13 in the case of the long hammer mechanism is insignificant. The velocity $v_1$ during the first phase 102 and the velocity $v_2$ during the second phase 103 remain approximately constant.

It is approximately assumed that the flying mass 13 and the exciting piston 12 touch each other at the first reversal point 104, at a distance x=L−½ H+b from the impact surface 27, wherein b is the length of the flying mass 13. Under the basic condition that within one period, i.e., the period of time $f^{-1}$, the distance L−½ H must be covered once by the flying mass 13 with the first velocity $v_1$ and once at the second velocity $v_2$, yields the following for the first velocity:

$$v_1 = \frac{2\pi \cdot f \cdot H}{1 - q}.$$

In the case of the short hammer mechanism 5, the trajectory 200 also has two reversal points 204, 205, which are produced by a minimum approach of the exciting piston 12 and a subsequent impact on the impact surface 27.

During the first phase 202, the flying mass 13 moves from the first reversal point 204 to the second reversal point 205, in a similar manner as with a long hammer mechanism. The velocity $v_1$ is approximately constant and is for instance $v_1=2\pi\cdot H\cdot f+v_3$, whereby $v_3$ is the velocity shortly before the first reversal point 204. For an estimate of the velocity $v_3=2f\cdot(a-½ H)$, it can be assumed that the movement from the impact surface 27 up to the first reversal point 204 takes place approximately during a half period ($½f^{-1}$).

The second phase 203 of the short hammer mechanism 5 differs from the second phase 103 of the long hammer mechanism. The velocity of the flying mass 13 is decelerated to zero, in the depicted example the movement of the flying mass 13 even reverses. The driving force for the deceleration is produced by the strong coupling of the flying mass 13 to the exciting piston 12 by means of the pneumatic chamber 19.

In the following, parameters of the hammer mechanism 5 are estimated, at which the velocity $v_2$ of the flying mass 13 is decelerated at least to zero after the second reversal point 205.

The decelerating force is produced by the excess pressure ($p-p_0$) of the pneumatic chamber 19 with respect to the environment, which excess pressure acts on the cross-sectional area A of the pneumatic chamber 19. Due to the movement of the flying mass 13 in the direction of the exciting piston 12, the volume V of the pneumatic chamber 19 also diminishes and the excess pressure ($p-p_0$) increases correspondingly. The pressure change can be determined based on the adiabatic approximation $$p \cdot V^{\kappa} = p_0 \cdot V_0^{\kappa}.$$

The deceleration takes place typically at the latest within a quarter of a period ($T=\frac{1}{4}f^{-1}$) after the second reversal point 205. During this period of time T, the exciting piston 12 moves slowly. A change in the pressure p in the pneumatic chamber 19 is dominated during the period of time T by the movement of the flying mass 13. After the period of time T, the exciting piston 12 reaches a velocity which is clearly greater than the velocity $v_2$ of the flying mass 13. The relative distance increases rapidly and is soon greater than ½L, which is why the flying mass 13 is again accelerated in the direction of the exciting piston 12.

During the period of time T, the position x1 of the exciting piston 12 is assumed to be approximately constantly equal to the minimum possible distance to the impact surface 27 ($x_1=L-H$). The volume of the pneumatic chamber V during the period of time T is yielded as: $V=A(L-H-v_2 \cdot t)$, wherein the velocity $v_2$ is assumed to calculate the volume V as constant.

The flying mass 13 stops when the integral of the decelerating force over period of time T corresponds to the pulse of the flying mass 13, i.e., $v_2 \cdot m_2$, after the second reversal point 204:

$$v_2 \cdot m_2 \overset{!}{<} \int_0^T A \cdot p_0 \cdot [(V_0/V)^{\kappa} - 1] dt.$$

Using the relationships described above and an expansion in series according to time up to the first order produces the following with $T=(N f)^{-1}$:

$$\frac{L^{\kappa}}{2(L-H)^{\kappa}} \cdot \frac{\kappa}{L-H} + \left(\frac{L^{\kappa}}{2(L-H)^{\kappa}} - 1\right) \cdot \frac{1-q}{q} \frac{N}{2\pi H} \overset{!}{\geq} \frac{m_2}{A \cdot p_0} \cdot N^2 f^2.$$

It is evident from the inequality that increasing the cross-sectional area A, the stroke H and/or reducing the mass $m_2$ of the flying mass 13, the maximum length L of the pneumatic chamber 19, the impact frequency f, tends to result in a hammer mechanism 5 in which the movement of the flying mass 13 is decelerated to a standstill.

Parameter N is preferably greater than 4, based on the described assumption that a deceleration takes place within a quarter period $T=\frac{1}{4}f^{-1}$.

It was stated in the introduction that selecting the impact frequency f and the mass $m_2$ of the flying mass 13 is subject to narrow restrictions. The cross-sectional area A of the pneumatic chamber 19 is closely coupled with the shape and impact properties of the flying mass 13. However, the external basic conditions can allow a largely free selection of the maximum length L of the pneumatic chamber 19 and the stroke H of the exciting piston 12.

For heavy hammer mechanisms 5 with a flying mass 13 of the mass $m_2$ greater than 400 g with otherwise typical parameters, such as a large impact coefficient ($q>0.2$), the selection of the ratio of maximum length L to the stroke H of: $L/H<1.55$ is suitable; and for light hammer mechanisms 5 with the mass $m_2$ less than 400 g, a selection of the ratio: $L/H<1.40$ is suitable.

The hammer mechanism 5 is preferably operated resonantly such that the first reversal point 204 and the greatest velocity of the exciting piston 12 coincide, i.e., a difference of the respective points of time of less than 2% of the cycle duration ($T=f^{-1}$).

In the case of resonant operation, it is assumed based on investigations of simulations and prototypes that a complete deceleration takes place within a period of time $T_0=\frac{3}{8}f^{-1}$ after the first reversal point 204. After the period of time $T_0$, the velocity of the exciting piston increases to 70% of its maximum value, whereby there is a rapid decrease in the decelerating excess pressure to an accelerating underpressure.

The flying mass 13 requires approximately a period of time from $\frac{1}{8}f^{-1}$ to $\frac{1}{4}f^{-1}$ for its movement to impact surface 27. The deceleration can take place within a period of time of $\frac{1}{8}f^{-1}$ to $\frac{1}{4}f^{-1}$, which is why N is at least 4, preferably 6 or 8. For a resonant operation, the parameters of the hammer mechanism 5 can be determined in accordance with the above inequality with the selected N.

In another embodiment, the parameters of the hammer mechanism 5 are selected such that the flying mass 13 in the hammer mechanism 5 touches the impact surface 27 (point 206) a second time after the second reversal point 205 before the flying mass 13 flies to the first reversal point 204. The lengthening of the trajectory of the flying mass 13 permits a greater velocity while maintaining the impact frequency f.

So that the flying mass 13 returns to the impact surface 27, the deceleration to a standstill must take place early on. Afterwards, an excess pressure must still prevail for a sufficiently long period of time in the pneumatic chamber 19 in order to accelerate the flying mass in the direction of the impact surface 27. It was recognized from investigations that this is achieved with a period of time $T_0$ of less than $\frac{2}{6}f^{-1}$. The velocity of the exciting piston 12 achieves only 50% of its maximum velocity within the period of time $T_0$. The hammer mechanism 5 can be designed in accordance with the above inequality, wherein N is selected as greater than 5, preferably greater than 8 or 10. The parameter N can be selected as greater than 8 for the two impacts during a cycle of the flying mass.

Figure 7:
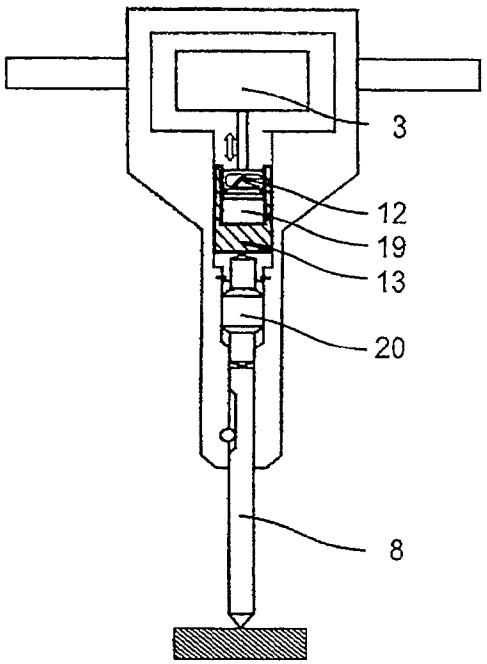
FIGS. 7 to 9 are additional hand power tools having hammer mechanisms.
Figure 8:
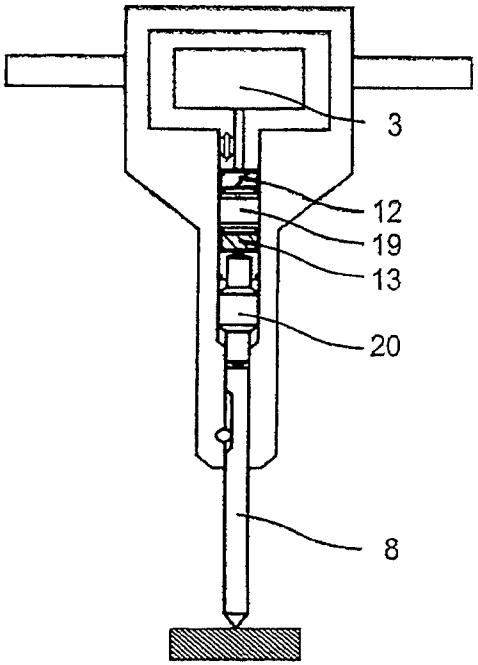
Figure 9:
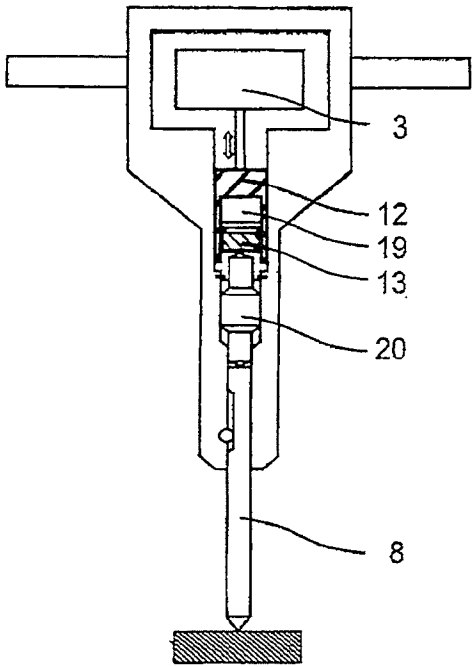

The elements of a hammer mechanism can be arranged in diverse ways. FIGS. 7 through 9 depict additional embodiments. The above outlined rules for designing the hammer mechanism in FIG. 4 can also be applied to these types of hammer mechanisms.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A pneumatic hammer mechanism, comprising:

a flying mass which is movable along an impact axis;

an impact surface which limits a movement of the flying mass along the impact axis in an impact direction;

an exciting piston which limits the movement of the flying mass along the impact axis opposite from the impact direction;

a pneumatic chamber disposed between the flying mass and the exciting piston; and a drive for periodically moving the exciting piston with a stroke along the impact axis, wherein the flying mass is excited to a periodic movement between the impact surface and a minimum approach of the exciting piston;

wherein a length ratio of a maximum length of the pneumatic chamber to the stroke is less than 1.55 such that an increase in impact energy is achievable due to a deceleration of the flying mass during a second phase of a cycle of the flying mass.

2. The pneumatic hammer mechanism according to claim 1, wherein if a mass of the flying mass is greater than 400 g the length ratio is less than 1.55 and if the mass of the flying mass is less than 400 g the length ratio is less than 1.40.

3. The pneumatic hammer mechanism according to claim 1, wherein if a ratio $m_1/m_2$ of a mass ($m_1$) of a snap die to a mass ($m_2$) of the flying mass is less than 1.2 the length ratio is less than 1.40.

4. The pneumatic hammer mechanism according to claim 1, wherein a mass ($m_2$) of the flying mass, a cross-sectional area (A) of the pneumatic chamber, a maximum length (L) of the pneumatic chamber, the stroke (H) of the exciting piston and an impact coefficient (q) fulfill the following inequality, if the hammer mechanism has an impact frequency (f) during percussive operation:

$$\frac{L^k}{2(L-H)^k}\cdot\frac{k}{L-H}+\left(\frac{L^k}{2(L-H)^k}-1\right)\cdot\frac{1-q}{q}\frac{N}{2\pi H}\overset{!}{\geq}\frac{m_2}{A\cdot p_0}\cdot N^2 f^2$$

wherein N is at least 4, $p_o$ designates an ambient pressure and κ an isentropic coefficient of gas in the pneumatic chamber.

5. The pneumatic hammer mechanism according to claim 4, wherein the impact coefficient (q) is 0.22 if a ratio $m_1/m_2$ of a mass ($m_1$) of a snap die to the mass ($m_2$) of the flying mass is greater than 1.2 and otherwise the impact coefficient (q) is 0.12.

6. The pneumatic hammer mechanism according to claim 4, wherein N is greater than 5.

7. The pneumatic hammer mechanism according to claim 1, wherein the periodic movement of the flying mass includes a velocity of zero at a position between the impact surface and the minimum approach of the exciting piston.

* * * * *